US006079966A

United States Patent [19]

Bearint et al.

[11] Patent Number: 6,079,966

[45] Date of Patent: Jun. 27, 2000

[54] COMPRESSOR HOUSING

[75] Inventors: David E. Bearint; James I. Miller, both of Decatur, Ill.

[73] Assignee: Zexel USA Corporation, Decatur, Ill.

[21] Appl. No.: 08/972,822

[22] Filed: Nov. 18, 1997

[51] Int. Cl.[7] ..... F01C 19/00

[52] U.S. Cl. ..... 418/149; 418/100; 418/98; 418/133; 418/270

[58] Field of Search ..... 418/98, 100, 133, 418/149, 270

[56] References Cited

U.S. PATENT DOCUMENTS

| | | | |
|---|---|---|---|
| 3,088,660 | 5/1963 | Voggenthaler | 418/98 |
| 4,484,868 | 11/1984 | Shibuya | 418/100 |
| 4,571,164 | 2/1986 | Shibuya | 418/98 |
| 5,049,041 | 9/1991 | Nakajima | 418/100 |

FOREIGN PATENT DOCUMENTS

| | | |
|---|---|---|
| 264005 | 4/1988 | European Pat. Off. . |
| 265774 A2 | 5/1988 | European Pat. Off. . |
| 2157769A | 10/1985 | United Kingdom . |

*Primary Examiner*—Thomas Denion
*Assistant Examiner*—Thai-Ba Trieu
*Attorney, Agent, or Firm*—Felsman Bradley Vaden Gunter & Dillon, LLP; James E. Bradley

[57] ABSTRACT

A variable capacity, vane-type compressor has a cylinder block with an oval rotor chamber. A plurality of vanes mounted in slots on a rotor rotate inside the rotor chamber on a shaft that is concentric with the minor diameter of the rotor chamber. Valves discharge refrigerant gas from the rotor chamber. The front nose block is located on the front side of the cylinder block and contains a bore for the rotor shaft and a set of needle roller bearings which supports the forward end of the shaft. A circular O-ring groove with an O-ring is located on the rearward side of the front nose block at its perimeter for sealing between the front nose block and the forward side of the cylinder block. The cylinder block has internal, weight-reducing voids located outboard of the rotor chamber. The lower voids serve as an oil sump and supply high pressure lubricant to the undervane pressurization manifolds. Like the front nose block groove, the cylinder block has a circular groove machined on a rearward side. The cylinder block groove contains an O-ring for sealing against the rear side block. The rear side block has a bore for the shaft and a needle roller bearing which supports the rearward end of the shaft. A circular O-ring groove is machined on the rearward side of the rear side block and holds an O-ring for sealing between the rear side block and the rear head. A lubricant transmitting passage is located in the blocks. The passage leads from the intake chamber at the rear of the compressor to the bore at the front radial bearing. Each of the components has bolt ears with threaded bolts for securing the components together. The bolt ears are located in the formerly wasted space at the four corners providing the compressor with a rectangular external configuration.

8 Claims, 4 Drawing Sheets

COMPRESSOR HOUSING

Technical Field

This invention relates in general to variable capacity vane compressors for air conditioning systems, particularly for vehicles.

BACKGROUND ART

Prior art compressors for vehicle air conditioners have cylindrical configurations. In the past, vehicle air conditioning compressors were normally ear mounted with longitudinal bolting that permitted the compressor to be pivoted to tighten the drive belt. For example, the compressor could pivot on a lower inside set of ears. A slotted arm engaged, for example, an upper outside set of ears. Once the proper belt tension was reached, the bolts were tightened to hold the position. The cylindrical shape of the compressor accommodated the arcuate slotted arm as the compressor was rotated to the proper position. The cylindrical configuration forced the through bolts that hold the compressor assembly together to lie inside the circular profile of the compressor. This presents O-ring gland sealing problems.

In modern accessory drive systems, the compressor is fixed, not pivotally mounted as described above. Belt tension is maintained by a separate spring loaded idler pulley. A modern compressor is also cross bolted. Current applications have relied on intermediate brackets between the compressor and presently available bolting points on the engine. However, motor vehicle manufacturers are planning engines that will provide standardized bolt boss configurations that will directly fit a compressor, eliminating a costly bracket and making for a more rigid and quieter application. As compressors are no longer pivotally mounted in modern drive systems, the historical reason for a cylindrical configuration is no longer valid. Nevertheless, current compressors still use the cylindrical configuration.

One newer type of automotive air conditioning compressor in use is a variable capacity, double-lobed, sliding-vane type compressor. This type of compressor has a more rectangular external configuration by moving the through bolt bosses out into the formally wasted space at the four corners. In this type of compressor, a compression housing has a chamber cavity that is oval in shape. A cylindrical rotor rotates within the chamber on a rotor shaft. The rotor has radial vanes mounted to it which slide in slots formed in the rotor. Refrigerant at suction pressure enters the compression chamber through a variable porting arrangement. The vanes compress the refrigerant, which passes outward through discharge ports in the cylinder wall past a check valve to the discharge plenum from which it exits the compressor.

Compressors of this nature usually comprise a plurality of primary components including a front head, a front side block, a cylinder block, a rear side block and a rear head. Each of these components has several bolt holes so that they may be joined together with bolts to form the compressor. The components must be sealed against one another to prevent leakage of the refrigerant working fluid to the atmosphere. These die cast components typically employ elastomeric O-rings in "as cast" grooves between the front side block and the cylinder block, and between the cylinder block and the rear side block. The front side block, cylinder block and rear side block must have metal-to-metal contact in order to hold very small dimensional clearances with internal running parts, that is, with the rotor and vanes. The small dimensional clearances control backflow leakage within the cylinder block.

Gaskets are typically employed between the front head and the front side block, and between the rear side block and the rear head to prevent refrigerant working fluid leakage to the atmosphere. Gasketed interfaces require high compressive clamping loads in order to develop an adequate bearing pressure to insure sealing. The typical bolting system holding the major components together therefore requires a large number of large diameter high tensile strength bolts. Since the bolts remain exposed to the atmosphere in the prior cylindrically shaped compressor, the elastomeric O-rings must seal around the inside of the bolt hole circle. This situation results in "as cast" grooves and O-rings configured in an irregular, that is, non-circular pattern. The irregular pattern requires that the grooves for the O-rings be cast with smooth high precision surfaces rather than be machined. It is extremely difficult and expensive to maintain an acceptable sealing surface in a die cast groove in a high production environment. Dies must be changed out within short time intervals to repair damage due to severe heat check temperature cycling and erosion. Finally, during assembly of the compressor, a liquid room temperature curing sealant is applied to the O-ring grooves as a redundant measure.

In the prior art, the weight of the cylinder block has been reduced with external depressions formed in the block during casting. The resulting thinner wall sections also reduce metal porosity and improve the structural integrity of the casting. However, such a casting die requires slides on the sides of the die, making the die expensive to manufacture and maintain. The lateral slides result in fewer cavities per die block because they take up space between the cavities.

The rotor shaft is typically supported on a bearing in the front head. Since the forward bearing and the main shaft seal need to be continuously lubricated, the prior art employs a lubricating passage extending from the intake plenum at the rear of the compressor through an axially drilled hole in the rotor shaft. A cross-drilled hole is also required at the forward end of the shaft. It is time consuming and therefore expensive to drill such holes in the rotor shaft. It is also expensive to insure the drilled holes are first free of any drilling debris and fragile burrs, and second clear of loose scale from subsequent heat treatment operations to harden, for example, the bearing journals on the shaft.

DISCLOSURE OF INVENTION

A variable capacity, vane-type compressor has a cylinder block with an oval rotor chamber. A plurality of vanes mounted in slots on a rotor rotate inside the rotor chamber on a rotor shaft that is concentric with the minor diameter of the rotor chamber. A disk-shaped rotary valve plate mounts rotationally to the intake side of the rotor chamber and functions as the variable porting member. An actuator piston translates within the rear side block between minimum and maximum stroke positions. The actuator piston extends transversely to the shaft in the rear side block. A groove in the actuator piston engages a drive pin on the rear face of the rotary valve plate, controlling the angular position of the plate. A control valve supplies control pressure to the actuator piston. Cartridge type check valves discharge refrigerant gas exiting the rotor chamber through ports in the cylinder wall. The refrigerant gas passes to a discharge chamber which is located in the cylinder block and from there to a discharge plenum volume located in both the front nose block and cylinder block.

The front nose block is located on the front side of the cylinder block. The front nose block contains a bore for the rotor shaft and a needle roller bearing which supports the forward end of the shaft. A circular O-ring groove with an elastomeric O-ring is located on the rearward side of the front nose block at its perimeter for sealing between the front nose block and the flat forward side of the cylinder block.

The cylinder block has internal voids located outboard of the rotor chamber. The voids are joined by webs and are designed to reduce the weight of the cylinder block. Like the groove in the front nose block, the cylinder block has a circular groove machined on a rearward side. The groove contains an elastomeric O-ring for sealing against the rear side block.

The rear side block has a bore for the shaft and a needle roller bearing which supports the rearward end of the shaft. A circular O-ring groove is machined on the rearward side of the rear side block. The groove holds an O-ring for sealing between the rear side block and the rear head.

An intake chamber is housed by the rear head and the rear side block. A lubricant transmitting passage is located in the blocks. The passage leads from the intake chamber to the bore at the front needle bearing position. A lubrication evacuation passage in the front nose block exits from between the main shaft seal and the bearing and leads to the suction portion of a cylinder lobe. Oil-laden refrigerant working fluid is drawn forward from the rear intake chamber to the front bearing and main shaft seal and exhausted to the suction portion of the cylinder to be recycled through the refrigeration system.

Undervane cavity pressurization manifolds are cast or machined in the rear face of the front nose block. The manifolds are supplied with lubricating oil at discharge pressure through passages originating in the lower oil sump voids formed in the front nose block and cylinder block. The high pressure oil assists centrifugal force to insure the vane tips engage the inner wall of the oval rotor chamber. The high pressure oil also serves to lubricate and seal the interfaces at both ends of the rotor.

Each of the four primary components of the compressor has four bolt ears with holes located in the four corners radially outboard of the respective O-ring grooves. Each set of four holes receives a threaded bolt which rigidly secures the major components together.

BEST MODE FOR CARRYING OUT THE INVENTION

Figure 1:
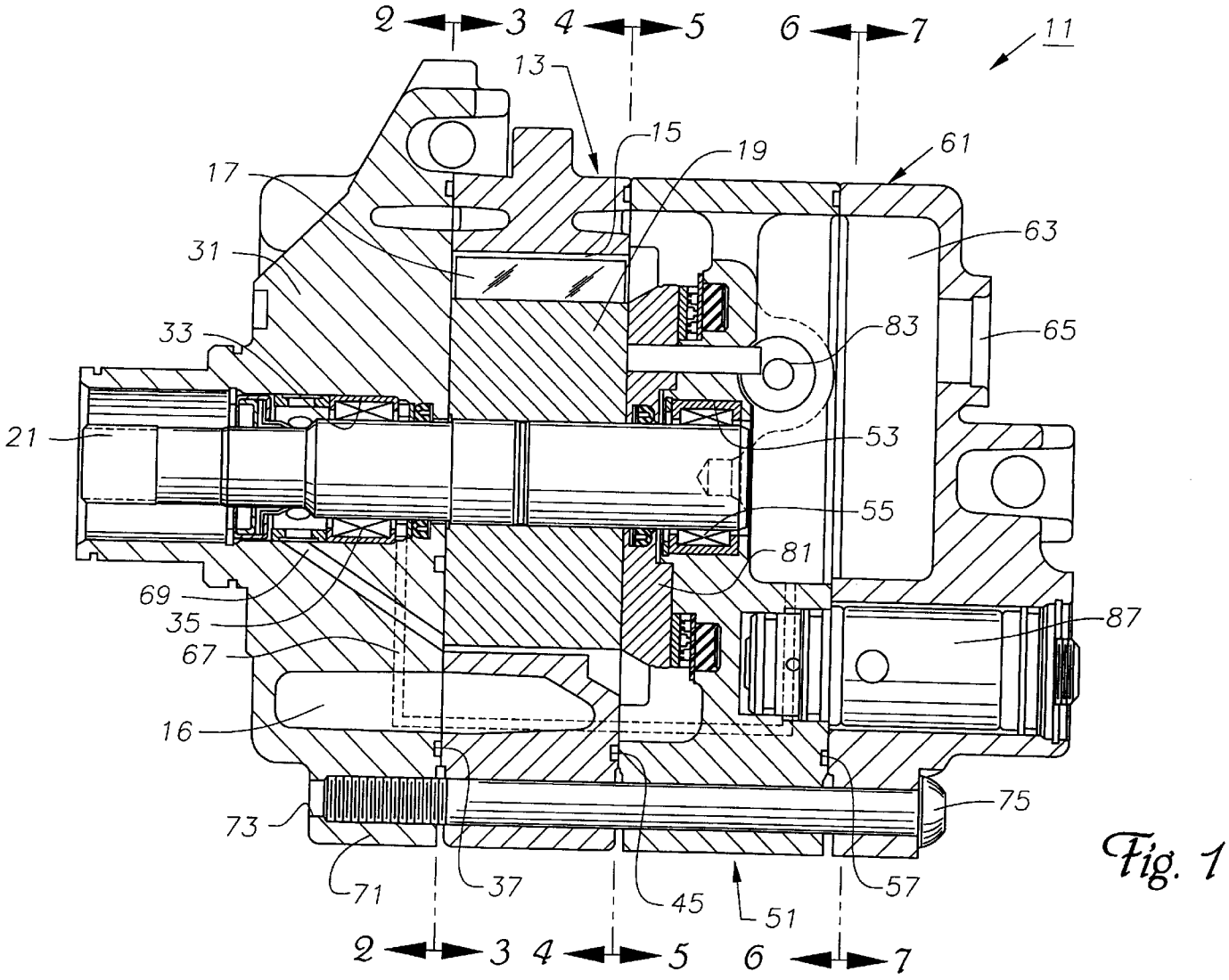
FIG. 1 is a partial sectional side view of a compressor constructed in accordance with the invention, with some out of plane parts rotated into view. Note one cross-bolting boss on the rear head.
Figure 3:
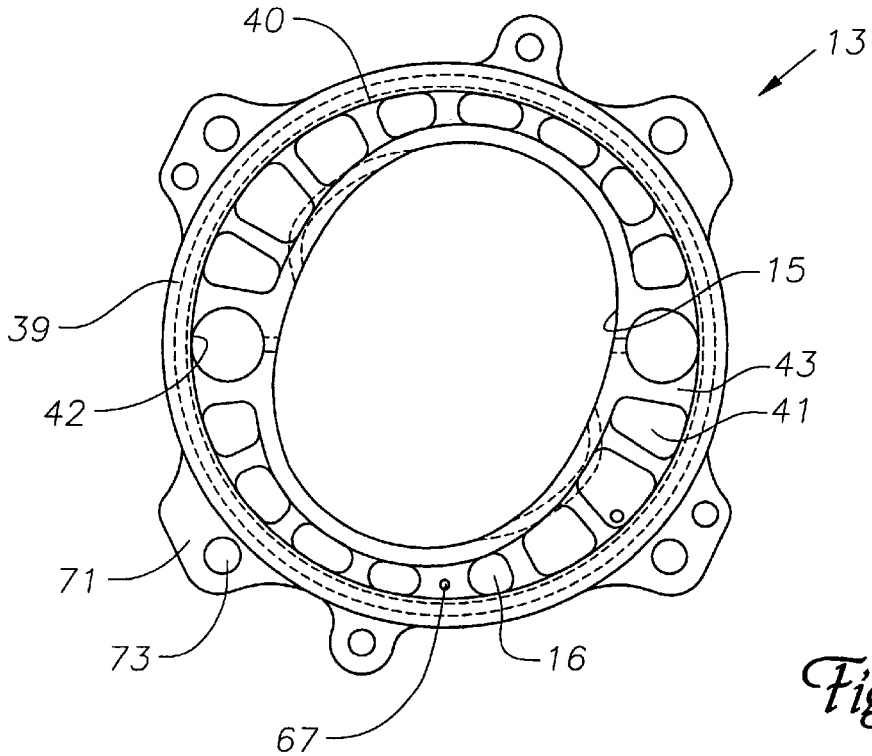
FIG. 3 is a front view of a cylinder block taken along the line 3—3 in FIG. 1.

Referring to FIG. 1, compressor 11 presents an external configuration that is generally square in cross-section and is a variable capacity, vane-type compressor. It includes a cylinder block 13 which has a rotor cavity or chamber 15. Rotor chamber 15 is generally oval is configuration (FIG. 3).

A plurality of vanes 17 mounted in slots on a rotor 19 rotate inside rotor chamber 15. Rotor 19 rotates on a rotor shaft 21 that is concentric with the minor diameter of rotor chamber 15. Valves (not shown) provide for the discharge of refrigerant gas from rotor chamber 15. The refrigerant gas passes to a discharge plenum or chamber 16 which is located in cylinder block 13 and a front nose block 31.

Figure 2:
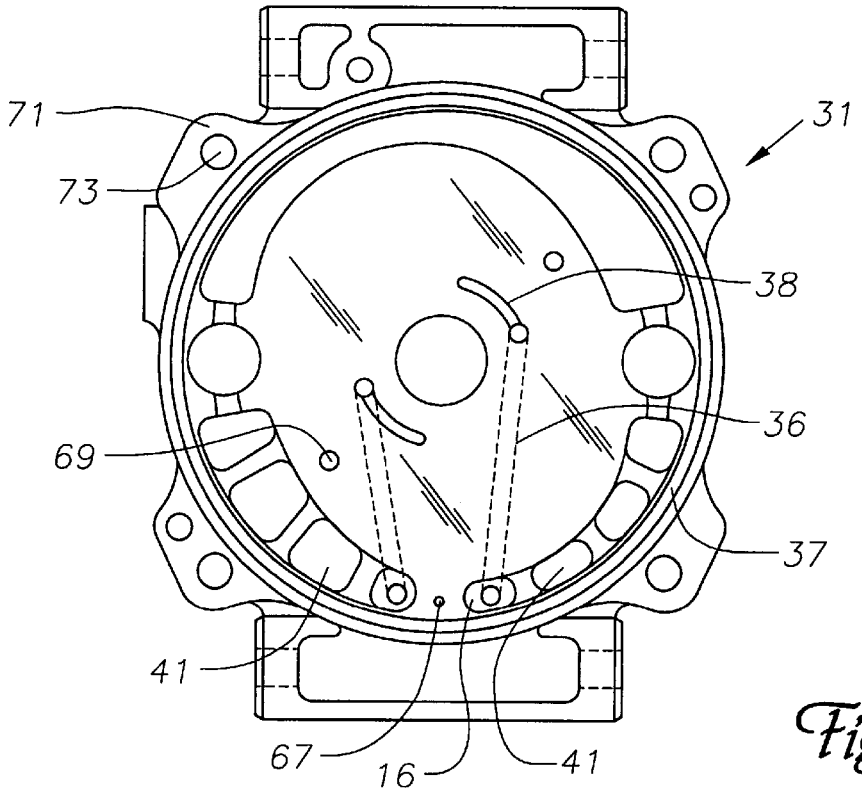
FIG. 2 is rear view of a front nose block taken along the line 2—2 in FIG. 1. Note cross-bolting bosses at the top and bottom.
Figure 4:
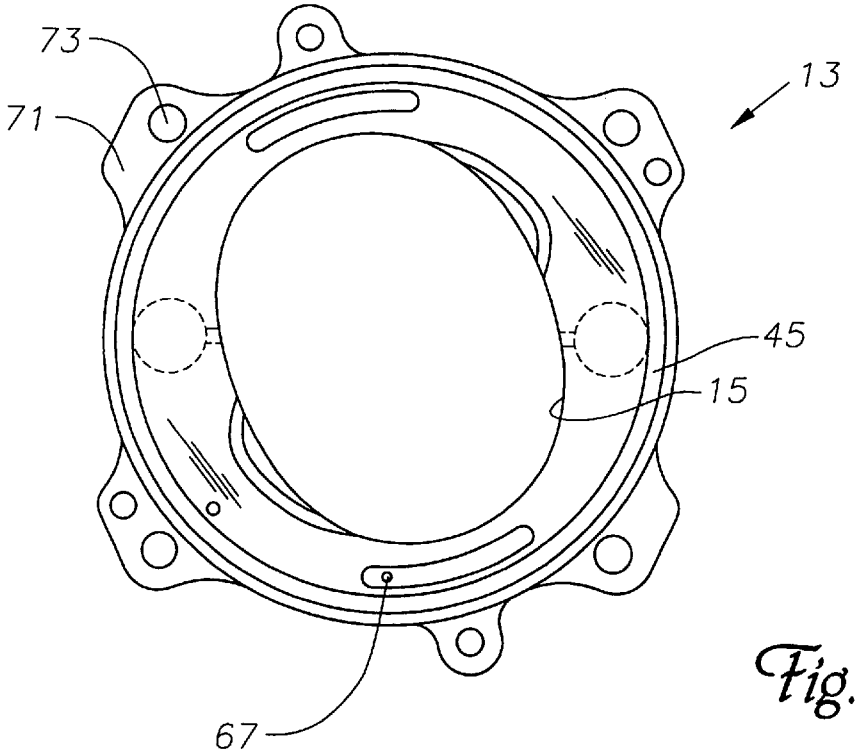
FIG. 4 is a rear view of the cylinder block taken along the line 4—4 in FIG. 1.

Referring to FIGS. 1 and 2, front nose block 31 is located on the front side of cylinder block 13. Front nose block 31 contains an opening or multi-diameter bore 33 for shaft 21 and a needle roller bearing 35 which supports the forward end of shaft 21. Also in bore 33 are the following: a snap ring, the main shaft seal, two spacers, and a U-cup seal. Referring to FIG. 2, a circular O-ring groove 37 is located on the rearward side of front nose block 31 at its perimeter. Groove 37 holds an O-ring (not shown) for sealing between front nose block 31 and a smooth surface 39 on the forward side of cylinder block 13 (FIG. 3). Front nose block 31 also has a plurality of internal voids 16 which are designed to act as discharge gas plenum and lube oil sump while reducing its weight. As shown in FIG. 3, cylinder block 13 has a plurality of weight-reducing internal voids 41 located outboard of rotor chamber 15. Voids 41 are joined to a perimeter 40 by webs 43. Voids 41 also act as a discharge gas plenum and lube oil sump. Passage ways 36 lead upward from the lowermost voids 16 to undervane pressurization manifolds 38. Voids 41 have a variety of configurations in order to maximize the weight reduction of cylinder block 13 while maintaining the necessary strength and rigidity required during machining and compressor operation. Two cylindrical holes 42 are formed in cylinder block 13 for receiving discharge valve assemblies (not shown). Like groove 37 in front nose block 31, cylinder block 13 has a circular groove 45 machined on its rearward side (FIG. 4). Groove 45 contains an O-ring (not shown) for sealing against a smooth surface 49 on the forward side of rear side block 51 (FIG. 5).

Figure 5:
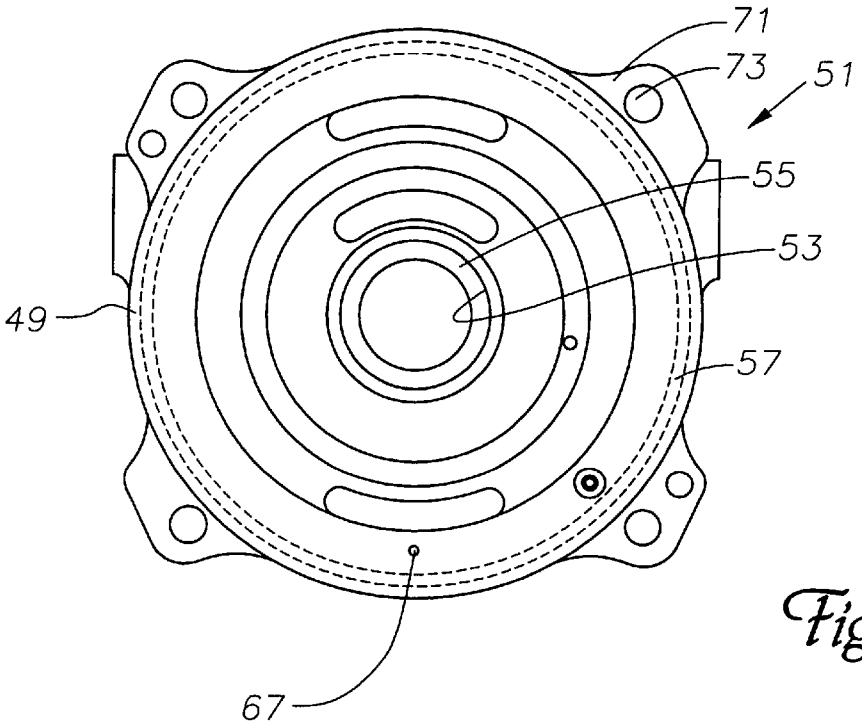
FIG. 5 is a front view of a rear side block taken along the line 5—5 in FIG. 1.
Figure 6:
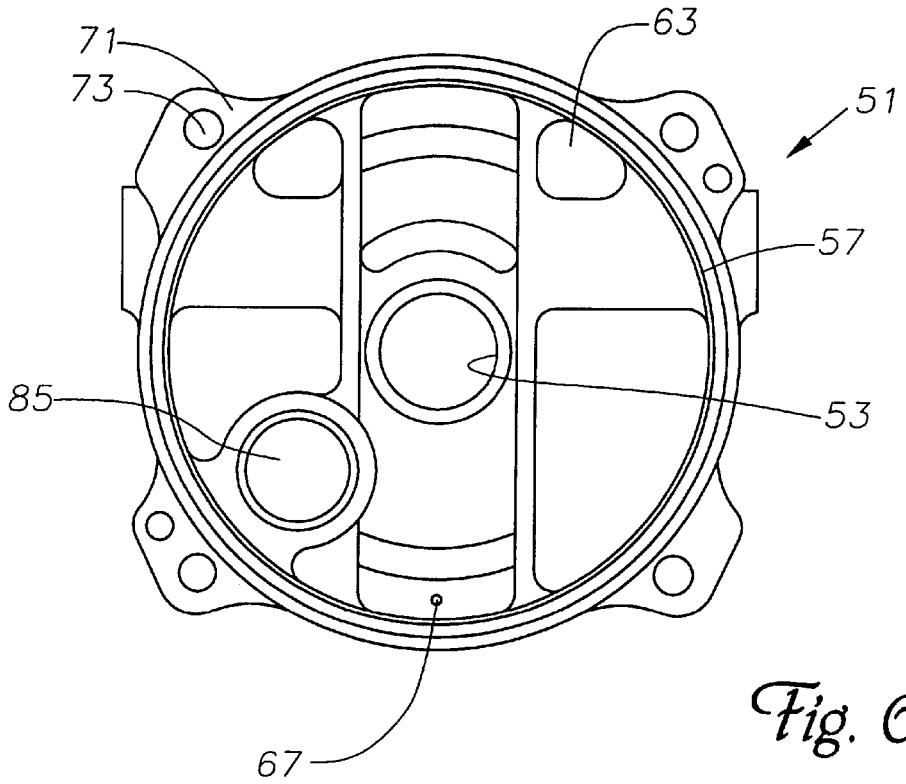
FIG. 6 is a rear view of the rear side block taken along the line 6—6 in FIG. 1.
Figure 7:
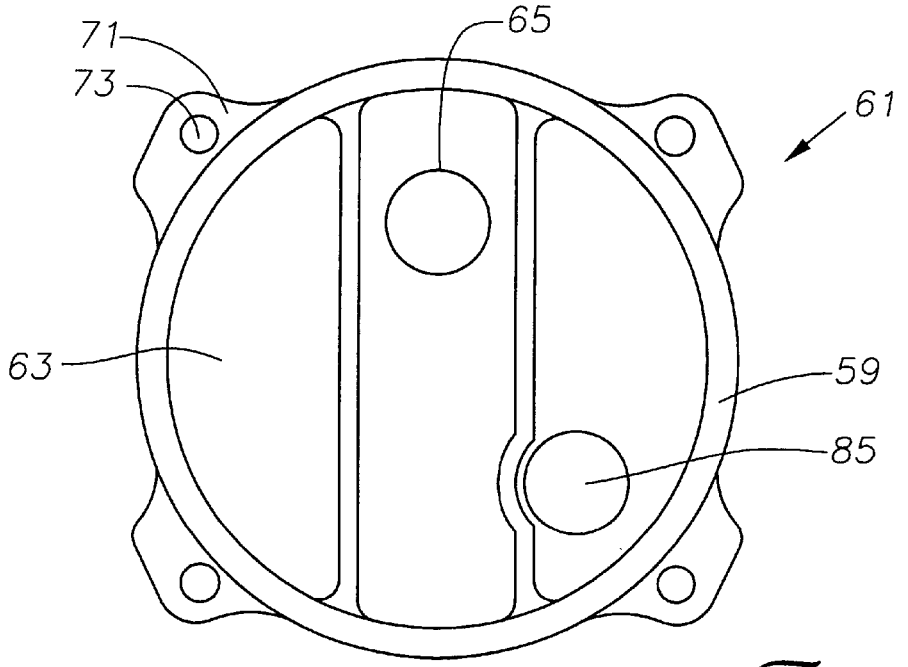
FIG. 7 is a front view of a rear head taken along the line 7—7 in FIG. 1.

Referring also to FIGS. 5 and 6, rear side block 51 contains a bore 53 for shaft 21 and a needle roller bearing 55 which supports the rearward end of shaft 21. A circular O-ring groove or gland 57 is machined on the rearward side of rear side block 51 at its perimeter. Groove 57 holds an O-ring (not shown) for sealing between rear side block 51 and a smooth surface 59 on the forward side of rear head 61 (FIGS. 6 and 7).

Referring to FIG. 1, an intake chamber 63 is housed by rear head 61 and rear side block 51. Rear head 61 has an intake port 65 leading from intake chamber 63 to the exterior of compressor 11. A lubricant transmitting passage 67 is located in rear side block 51, cylinder block 13 and front nose block 31. Passage 67 leads from intake chamber 63 to bore 33 at the rear spacer to the rear of bearing 35. Two lubrication evacuation passages 69 in front nose block 31 lead from bore 33 at a forward end of bearing 35 to rotor chamber 15 which will be at the lowest pressure in the compressor during operation. Passage 67 draws in oil-laden refrigerant from intake chamber 63 to bore 33 to lubricate the U-cup seal, bearing 35, and the main shaft seal. The refrigerant flows through bearing 35 and is evacuated from bore 33 and drawn into rotor chamber 15 before being discharged through the discharge port and recycled.

Each of the four primary components of compressor 11, front nose block 31, cylinder block 13, rear side block 51 and rear head 61, has a plurality of bolt ears 71. In the preferred embodiment, there are four bolt ears 71 per component. Bolt ears 71 are located radially outboard of the respective O-ring grooves 37, 45, 57 in each component relative to shaft 21. Each bolt ear 71 has a hole 73 that aligns with three other holes 73 in the other components. Each set of four holes 73 receives a threaded bolt 75. Holes 73 in front nose block 31 are threaded for engaging bolts 75. The remaining holes 73 are clearance type. Bolts 75 rigidly secure the four primary components of compressor 11 together.

Referring again to FIG. 1, a disk-shaped rotary valve plate 81 mounts rotationally to the intake side of rotor chamber 15. The particular rotational position of rotary valve plate 81 will change the position of the intake opening into the rotor chamber 15 and thus the volume of refrigerant retained for the compression process.

An actuator spool or piston 83 moves linearly in rear side block 51 to rotate valve plate 81 between minimum and maximum intake positions. Actuator piston 83 extends transversely to shaft 21 in rear side block 51. A control valve 87 locates in cavity 85 and supplies control pressure to actuator piston 83.

The invention has several advantages. By moving the through bolt ears out into the four empty corners beyond the cylindrical body of the compressor, circular elastomeric O-ring grooves can be utilized instead of the irregular shapes typically employed. Circular grooves provide a better seal than irregularly shaped grooves. The grooves can be easily machined and do not need to be cast. O-rings, which require less compressive force to seal than gaskets, are used in place of gaskets to seal all four major components to the atmosphere. This improvement also reduces the number and the size of the bolts required to hold the compressor components together. The voids in the cylinder block reduce the overall weight of the compressor. The internal position of the voids eliminates the need for a casting die with lateral S slides, thereby reducing cost and maintenance. In addition, more die cavities can be used per die block than in the prior art. The lubricant transmitting passage extends through the component blocks rather than through the shaft as is common in the prior art, thereby reducing the cost of manufacturing a debris-free shaft. This overall design also reduces the number of primary components required from five to four.

While the invention has been shown in only one of its forms, it should be apparent to those skilled in the art that it is not so limited, but is susceptible to various changes without departing from the scope of the invention.

We claim:

1. A compressor having a rotor and a rotor shaft, comprising in combination:

a front nose block having a discharge plenum;

a cylinder block having a longitudinal axis and a rotor cavity for receiving the rotor;

a rear side block having an intake plenum, the cylinder block being located between the front nose block and the rear side block;

a rear head located rearward of the rear side block;

the rotor shaft extending through the cylinder block being supported in the front nose block and rear side block;

each of the blocks having a machined O-ring groove which defines a circular path about the longitudinal axis and is located next to a periphery of each of the blocks for sealing interfaces between the blocks and the rear head;

each of the blocks and the rear head having a plurality of bolt ears with holes located radially outboard of the O-ring groove relative to the rotor shaft; and a plurality of bolts extending through the holes for fastening the blocks and the rear head together.

2. A compressor having a rotor and a rotor shaft, comprising in combination:

a front nose block having a discharge plenum;

a cylinder block having a rotor cavity for receiving the rotor and a plurality of internal weight-reducing voids joined by supporting ribs located outboard of the rotor cavity;

a rear side block having an intake plenum, the cylinder block being located between the front nose block and the rear side block;

a rear head located rearward of the rear side block;

the rotor shaft extending through the cylinder block being supported in the front nose block and rear side block;

each of the blocks having a machined circular O-ring groove located next to a periphery of each of the blocks for sealing interfaces between the blocks and the rear head;

each of the blocks and the rear head having a plurality of bolt ears with holes located radially outboard of the O-ring groove relative to the rotor shaft; and a plurality of bolts extending through the holes for fastening the blocks and the rear head together.

3. The compressor of claim 1, further comprising:

bearings in the front nose block for supporting the rotor shaft;

a lubricant transmitting passage in the cylinder block, front nose block and rear side block for allowing lubricating fluid to flow to the bearings from the intake plenum; and wherein the rotor shaft is solid.

4. A compressor having a rotor and a rotor shaft, comprising in combination:

a front nose block having a discharge plenum;

a cylinder block having a rotor cavity and a plurality of weight-reducing internal voids joined to a perimeter of the cylinder block by supporting ribs, the voids being located outboard of the rotor cavity;

a rear side block having an intake plenum, the cylinder block being located between and secured to the front nose block and the rear side block;

a rear head secured to the rear side block; the rotor shaft extending through the cylinder block and being supported in the front nose block and rear side block; and each of the blocks having a circular O-ring groove located near a periphery of each of the blocks for sealing interfaces between each block and the rear head.

5. The compressor of claim 4, further comprising a plurality of bolt ears with holes for receiving bolts located outboard of the O-ring groove.

6. The compressor of claim 4 wherein the O-ring groove in the cylinder block is located radially outboard of the voids relative to the shaft.

7. The compressor of claim 4, further comprising:

bearings in the front nose block for supporting one end of the rotor shaft;

a lubricant transmitting passage in the rear side block, cylinder block and front nose block leading from the intake plenum to the bearings; and an evacuation passage in the front nose block leading from the bearings to a negative pressure portion of the rotor cavity.

8. A compressor having a rotor and a rotor shaft, comprising in combination:

a front nose block having a discharge plenum;

a cylinder block having a rotor cavity and a plurality of weight-reducing internal voids located outboard of the rotor cavity;

a rear side block having an intake plenum, the cylinder block being located between and secured to the front nose block and the rear side block;

a rear head secured to the rear side block;

the rotor shaft extending through the cylinder block and being supported in the front nose block and rear side block;

bearings in the front nose block for supporting one end of the rotor shaft;

a lubricant transmitting passage in the rear side block, cylinder block and front nose block leading from the intake plenum to the bearings;

an evacuation passage in the front nose block leading from the bearings to a negative pressure portion of the rotor cavity;

each of the blocks having a circular O-ring groove located at a perimeter for sealing interfaces between each block and the rear head, the O-ring groove in the cylinder block being located radially outboard of the voids relative to the shaft;

a plurality of bolt ears with holes on each of the blocks and the rear head for receiving bolts, the bolt ears being located outboard of the O-ring grooves; and wherein the rotor shaft is solid.

* * * * *